US006743266B2

(12) United States Patent
DeRosa et al.

(10) Patent No.: US 6,743,266 B2
(45) Date of Patent: Jun. 1, 2004

(54) FUEL ADDITIVE COMPOSITION FOR IMPROVING DELIVERY OF FRICTION MODIFIER

(75) Inventors: Thomas F. DeRosa, Wallingford, CT (US); Benjamin J. Kaufman, Hopewell Junction, NY (US); Frank J. DeBlase, Hopewell Junction, NY (US); Thomas E. Hayden, Wappingers Falls, NY (US); Michael G. Rawdon, Poughkeepsie, NY (US); James R. Ketcham, Salt Point, NY (US); Yvonne Thiel, Carmel, NY (US); Max R. Cesar, Newburgh, NY (US)

(73) Assignee: Texaco, Inc., San Ramon, CA (US)

( * ) Notice: Subject to any disclaimer, the term of this patent is extended or adjusted under 35 U.S.C. 154(b) by 70 days.

(21) Appl. No.: 10/217,997

(22) Filed: Aug. 13, 2002

(65) Prior Publication Data

US 2003/0009930 A1 Jan. 16, 2003

Related U.S. Application Data

(63) Continuation of application No. 09/540,349, filed on Mar. 31, 2000, now abandoned.

(51) Int. Cl.[7] ..... C10L 1/18; C10L 1/22

(52) U.S. Cl. ..... 44/391; 44/418; 44/412; 44/415; 44/417; 44/347

(58) Field of Search ..... 44/388, 391, 418, 44/412, 415, 417, 347

(56) References Cited

U.S. PATENT DOCUMENTS

| | | | |
|---|---|---|---|
| 2,252,889 | A | 8/1941 | Haseltine |
| 3,273,981 | A | 9/1966 | Furey |
| 3,368,972 | A | 2/1968 | Otto et al. |
| 3,413,347 | A | 11/1968 | Worrel et al. |
| 3,442,808 | A | 5/1969 | Traise et al. |
| 3,539,633 | A | 11/1970 | Piasek et al. |
| 3,725,277 | A | 4/1973 | Worrel |
| 4,185,594 | A | 1/1980 | Perilstein |
| 4,204,481 | A | 5/1980 | Malec |
| 4,208,190 | A | 6/1980 | Malec |
| 4,208,293 | A | 6/1980 | Zaweski |
| 4,231,759 | A | 11/1980 | Udelhofen et al. |
| 4,396,517 | A | 8/1983 | Gemmill, Jr. et al. |
| 4,427,562 | A | 1/1984 | Horodysky et al. |
| 4,428,182 | A | 1/1984 | Allen et al. |
| 4,439,336 | A | 3/1984 | Zaweski |
| 4,617,026 | A | 10/1986 | Shaub et al. |
| 4,717,492 | A | 1/1988 | Chibnik |
| 4,729,769 | A | 3/1988 | Schlicht et al. |
| 4,787,996 | A | 11/1988 | Horodysky et al. |
| 4,822,507 | A | 4/1989 | Kanamori et al. |
| 5,089,028 | A | 2/1992 | Abramo et al. |
| 5,112,364 | A | 5/1992 | Rath et al. |
| 5,194,068 | A | 3/1993 | Mohr et al. |
| 5,282,990 | A | 2/1994 | Yoneto et al. |
| 5,306,313 | A | 4/1994 | Emert et al. |
| 5,514,190 | A | 5/1996 | Cunningham et al. |
| 5,522,906 | A | 6/1996 | Hashimoto et al. |
| 5,551,957 | A | 9/1996 | Cunningham et al. |
| 5,578,090 | A | 11/1996 | Bradin |
| 5,634,951 | A | 6/1997 | Colucci et al. |
| 5,679,116 | A | 10/1997 | Cunningham et al. |
| 5,697,988 | A | 12/1997 | Malfer et al. |
| 5,725,612 | A | 3/1998 | Malfer et al. |
| 5,752,989 | A | 5/1998 | Henley et al. |
| 5,855,628 | A | 1/1999 | Hashimoto et al. |
| 5,891,203 | A | 4/1999 | Ball et al. |
| 6,001,141 | A | 12/1999 | Quigley |
| 6,010,545 | A | 1/2000 | Davies et al. |
| 6,511,520 | B1 * | 1/2003 | Eber et al. ..... 44/388 |

FOREIGN PATENT DOCUMENTS

| | | |
|---|---|---|
| CA | 2046004 | 12/1991 |
| CA | 2089833 | 2/1993 |
| CA | 2190243 | 11/1996 |
| EP | 0227218 | 7/1987 |
| EP | 0608149 | 7/1994 |
| EP | 0635558 | 1/1995 |
| EP | 0647700 | 4/1995 |
| EP | 0680506 | 11/1995 |
| EP | 0773279 | 5/1997 |
| EP | 0798364 | 10/1997 |
| EP | 0811672 | 12/1997 |
| EP | 0839174 | 5/1998 |
| EP | 0859040 | 8/1998 |
| EP | 0936265 | 8/1999 |
| EP | 0957152 | 11/1999 |
| GB | 2307246 | 5/1997 |
| GB | 2307247 | 5/1997 |
| WO | WO 9816599 | 4/1998 |
| WO | WO 9900467 | 1/1999 |
| WO | WO 9933938 | 7/1999 |

* cited by examiner

*Primary Examiner*—Cephia D. Toomer
(74) *Attorney, Agent, or Firm*—Dilworth & Barrese, LLP

(57) ABSTRACT

A fuel additive composition for improving the delivery of friction modifier to the lubricant oil of an internal combustion engine comprising (a) a friction modifying amount of a reaction product of at least one natural or synthetic oil and at least one alkanolamine; and, (b) at least one fuel detergent is provided. Also provided is a fuel composition containing the fuel additive composition and a method for operating an engine employing the fuel composition therefor.

61 Claims, No Drawings

FUEL ADDITIVE COMPOSITION FOR IMPROVING DELIVERY OF FRICTION MODIFIER

CROSS-REFERENCE TO RELATED APPLICATIONS

This application is a continuation of U.S. application Ser. No. 09/540,349, filed Mar. 31, 2000 now abandoned.

BACKGROUND OF THE INVENTION

This invention relates to a fuel additive composition for improving the delivery of friction modifier to the lubricant oil in an engine, a fuel composition containing the additive and to a method for operating an engine employing the fuel therefore.

The combustion of fuel in an internal combustion engine typically results in the formation and accumulation of deposits on various parts of the combustion chamber and on the fuel intake and exhaust systems of the engine. The presence of these deposits in the combustion chamber often result inn the following problems: (1) reduction in the operating efficiency of the engine; (2) inhibition in the heat transfer between the combustion chamber and the engine cooling system; and (3) reduction in the volume of the combustion zone which can cause a higher than design compression ratio in the engine. A knocking engine can also result from deposits forming and accumulating in the combustion chamber.

A prolonged period of a knocking engine can result in stress fatigue and wear in engine components such as, for example, pistons, connecting rods bearings and cam rods. The rate of wear tends to increase under harsh temperature and pressure conditions which exist inside the engine. In addition to limiting the useful life of the components in the engine being used, wear of the components can be costly because the engine components themselves are expensive to produce. Other significant problems associated with wear include, for example, down time for equipment, reduced safety and diminished reliability.

One approach to achieving enhanced fuel economy and thereby reducing the wear of engine components is by improving the efficiency of the internal combustion engine in which the fuel is used. Improvement in the engine's efficiency can be achieved through a number of methods, e.g., (1) improving control over fuel/air ratio; (2) decreasing the crankcase oil viscosity; and, (3) reducing the internal friction of the engine in certain specific areas due to wear. In method (3), for example, inside an engine, about 18 percent of the fuel's heat value, i.e., the amount of heat released in the combustion of the fuel and therefore able to perform work, is dissipated due to internal friction at engine components, e.g., bearings, valve train, pistons, rings, water and oil pumps, etc. Only about 25 percent of the fuel's heat value is converted to useful work at the crankshaft. Friction occurring at the piston rings and parts of the valve train account for over 50 percent of the heat value loss. A lubricity improving fuel additive capable of reducing friction at these engine components by a third preserves an additional three percent of the fuel's heat value for useful work at the crankshaft. Therefore, there has been a continual search for fuel additives which improve the delivery of friction modifier to strategic areas of the engine thereby improving the fuel economy of engines.

For example, U.S. Pat. Nos. 2,252,889, 4,185,594, 4,208,190, 4,204,481 and 4,428,182 disclose anti-wear additives for fuels adapted for use in diesel engines consisting of fatty acid esters, unsaturated dimerized fatty acids, primary aliphatic amines, fatty acid amides of diethanolamine and long-chain aliphatic monocarboxylic acids.

U.S. Pat. No. 4,427,562 discloses a friction reducing additive for lubricants and fuels formed by the reaction of primary alkoxyalkylamines with carboxylic acids or alternatively by the ammonolysis of the appropriate formate ester.

U.S. Pat. No. 4,729,769 discloses a detergent additive for gasoline, which contains the reaction product of a $C_6$–$C_{20}$ fatty acid ester such as coconut oil and a mono- or di-hydroxy hydrocarbyl amine such as diethanolamine or dimethylaminopropylamine.

SUMMARY OF THE INVENTION

In accordance with the present invention, a fuel additive composition is provided which comprises:

(a) a friction modifying amount of a reaction product of at least one natural or synthetic oil and at least one alkanolamine; and, (b) at least one fuel detergent selected from the group consisting of Mannich base detergents, polyetheramines, polyolefin-amines, polyolefin-polyamines, polyolefin-phenol-polyamines, polyolefin succinimides and mixtures thereof.

Further in accordance with the present invention, a fuel composition is provided which comprises:

(a) a major amount of an internal combustion engine fuel; and, (b) a minor effective amount of a fuel additive composition comprising:

(i) a friction modifying amount of a reaction product of at least one natural or synthetic oil and at least one alkanolamine; and, (ii) at least one fuel detergent selected from the group consisting of Mannich base detergents, polyetheramines, polyolefin-amines, polyolefin-polyamines, polyolefin-phenol-polyamines, polyolefin succinimides and mixtures thereof.

Yet further in accordance with the present invention, a method of operating an internal combustion engine is provided which comprises operating the engine employing as a fuel therefor a fuel composition which comprises:

(a) a major amount of an internal combustion engine fuel; and, (b) a minor effective amount of a fuel additive composition comprising:

(i) a friction modifying amount of a reaction product of at least one natural or synthetic oil and an alkanolamine; and, (ii) at least one fuel detergent selected from the group consisting of Mannich base detergents, polyetheramines, polyolefin-amines, polyolefin-polyamines, polyolefin-phenol-polyamines, polyolefin succinimides and mixtures thereof.

Still yet further in accordance-with the present invention, a method for reducing and/or preventing friction in the operation of an internal combustion engine which comprises fueling the engine with a fuel composition comprising (a) a major amount of an internal combustion engine fuel and (b) a minor effective amount of a fuel additive composition comprising:

(i) a friction modifying amount of a reaction product of at least one natural or synthetic oil and an alkanolamine; and, (ii) at least one fuel detergent selected from the group consisting of Mannich base detergents, polyetheramines, polyolefin-amines, polyolefin-polyamines, polyolefin-phenol-polyamines, polyolefin succinimides and mixtures thereof.

The term "fuel" as utilized herein shall be understood as referring to a hydrocarbon fuel such as gasoline or diesel, alcoholic fuels such as methanol or ethanol or mixtures of hydrocarbon and alcoholic fuels.

The term "diesel" as utilized herein shall be understood as referring to that fraction of crude oil that distills after kerosene and is useful for internal combustion in compression-ignition engines.

The term "gasoline" as utilized herein shall be understood as referring to a fuel for spark-ignition internal combustion engines consisting essentially of volatile flammable liquid hydrocarbons derived from crude petroleum by processes such as distillation reforming, polymerization, catalytic cracking, and alkylation.

The term "natural oil" utilized herein refers to those naturally occurring oils that are derived from animal or plant sources. Such oils are mixed $C_6$–$C_{22}$ fatty acid esters, i.e., glycerol fatty acid esters, and include specifically coconut oil, babassu oil, palm kernel oil, palm oil, olive oil, castor oil, rape oil, beef tallow oil, whale oil, sunflower, cottonseed oil, linseed oil, tung oil, tallow oil, lard oil, peanut oil, soya oil, etc. It will be understood that such oils will predominately comprise triglycerides with small amounts, e.g. up to about 10 weight percent, of mono- and diglycerides.

The term "synthetic oil" utilized herein refers to products produced by reacting carboxylic acids with glycerol, e.g., glycerol triacetate, and the like. It will be understood that such synthetic oils can contain between about 0.1 wt. % to about 20 wt. % mono- and di-glycerides, and mixtures thereof.

By employing a fuel additive composition formed from (1) a friction modifying amount of the reaction product of at least one natural or synthetic oil with at least one alkanolamine; and, (2) at least one fuel detergent in a fuel composition it has surprisingly been discovered that the friction modifying amount of the reaction product, i.e., the friction modifier contained therein, can be delivered to the cylinder walls of an engine thus reducing friction therein and then subsequently migrating into the crankcase lubricant oil thereby enhancing the friction modifying properties of the lubricant oil in other parts of the engine. While not wishing to be bound by theory, it is believed that a mechanism for the detergent additive boosting the delivery of friction modifier to the lubricant is as follows. Upon exiting the carburetor or fuel injector, gasoline is present as small droplets. These droplets immediately start to evaporate, providing vapor which burns in the engine. The lowest molecular weight constituents are the first to evaporate, and conversely, the heaviest components are left behind. See, Shibata et al., "Effect of Intake Valve Deposits and Gasoline Composition on S.I. Engine Performance", Society of Automotive Engineers, Warrandale, Pa. (1992). Under typical engine operating conditions (e.g., temperature and residence time) the active components of the friction modifier and in deposit control additives do not evaporate.

As applied to the invention described herein, when a friction modifier dissolved in gasoline where the gasoline is completely evaporated under operating conditions, the friction modifier is not evaporated under these same conditions (the friction modifier concentration is 230 parts per million by volume (ppmv)). For an initial droplet which upon exiting the carburetor/injector has a diameter of 100 microns, the volume of this droplet is 523,600 cubic microns. After the gasoline has evaporated, the droplet is comprised of the friction modifier, and the volume is 0.00023 times the volume of the starting droplet, or 120 cubic microns. This equates to a diameter of 6.1 microns. At a presumed density of 1 g/cm$^3$, the mass of this droplet would be $1.2\times10^{-10}$ grams.

Addition of a fuel deposit control additive to the fuel composition increases the amount of nonvolatile material, which in turn leads to larger residual droplets after the gasoline has evaporated. The increase in residual droplet mass will be in direct proportion to the amount of nonvolatile deposit control component(s) added. For a typical fuel, the deposit control components add 320 ppmv to the fuel. Thus, the concentration of nonvolatile material becomes 550 ppmv, and the mass of the residual droplet resulting from an initial droplet of 100 microns diameter becomes $2.9\times10^{-10}$ grams.

More massive droplets are less prone to being entrained in the swirling gases within the cylinder, and are more readily impinged on the cylinder wall. Once there, the friction modifier is able to reduce friction and flow downward to the oil sump. Therefore, larger, more massive residual droplets due to a higher concentration of nonvolatile additive in the gasoline results in more efficient delivery to the cylinder wall and to the engine oil.

DETAILED DESCRIPTION OF THE PREFERRED EMBODIMENTS

The fuel additive composition of this invention is obtained from (a) a friction modifying amount of a reaction product of at least one natural or synthetic oil and at least one alkanolamine; and, (b) at least one fuel detergent.

Natural oils such as mixed $C_6$–$C_{22}$ fatty acid esters, i.e., glycerol fatty acid esters or triglycerides derived from natural sources, for use herein include, but are not limited to, beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil and the like with coconut oil being the preferred natural oil.

The natural oil(s) which can be employed in the fuel additive composition of this invention will typically contain $C_6$–$C_{22}$ fatty acid esters, i.e., several fatty acid moieties, the number and type varying with the source of the oil. Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Preferably, the acid is saturated. Examples of unsaturated fatty acids include, myristoleic acid, palmitoleic acid, oleic acid, linolenic acid, and the like. Examples of saturated fatty acids include caproic acid, caprylic acid, capric acid, lauric acid, myristic acid, palmitic acid, stearic acid, arachidic acid, behenic acid, lignoceric acid, and the like.

The acid moiety may be supplied in a fully esterfied compound or one which is less than fully esterfied, e.g., glyceryl tri-stearate, or glyceryl di-laurate and glyceryl mono-oleate, respectively. Esters of polyols including diols and polyalkylene glycols can be employed such as esters of mannitol, sorbitol, pentaerytherol, polyoxyethylene polyol and the like.

Synthetic oils for use herein include alkoxylated alkylphenols, alkoxylated alcohols, polyalkeneoxide based alcohols and diols, esters thereof employing carboxylic acids, ethers of the foregoing compounds, esters of aliphatic acids, e.g., polybasic acids, and esters of aliphatic alcohols, e.g., polyhydric alcohols, and the like.

The alkanolamine which is reacted with the natural or synthetic oil(s) to form a reaction product can be a primary or secondary amine which possesses at least one hydroxy group. The alkanolamine corresponds to the general formula $HN(R'OH)_{2-x}H_x$ wherein R' is a lower hydrocarbyl having from about two to about six carbon atoms and x is 0 or 1. The expression "alkanolamine" is used in its broadest sense to include compounds containing at least one primary or secondary amine and at least one hydroxy group such as, for example, monoalkanolamines, dialkanolamines, and so forth. It is believed that almost any alkanolamine can be used, although preferred alkanolamines are lower alkanolamines having from about two to about six carbon atoms. The alkanolamine can possess an O or N functionality in addition to the one amino group (that group being a primary or secondary amino group) and the at least one hydroxy group. Suitable alkanolamines for use herein include monoethanolamine, diethanolamine, propanolamine, isopropanolamine, dipropanolamine, di-isopropanolamine, butanolamines, aminoethylaminoethanols, e.g., 2-(2-aminoethylamino)ethanol, and the like with diethanolamine being preferred. It is also contemplated that mixtures of two or more alkanolamines can be employed.

In general, the reaction can be conducted by heating the mixture of natural or synthetic oil(s) and alkanolamine in the desired ratio to produce the desired reaction product. The reaction can typically be conducted by maintaining the reactants at a temperature of from about 100° C.–200° C. and preferably from about 120° C.–150° C. for a time period ranging from about 1–10 hours and preferably from about 2–4 hours. Typically, the weight ratio of natural or synthetic oil(s) to alkanolamine will ordinarily range from about 0.2 to about 3 and preferably from about 0.7 to about 2.

If desired, the reaction can be carried out in solvent, preferably one which is compatible with the ultimate composition in which the product is to be used. Useful solvents include, but are not limited to, Aromatic-100, Aromatic-150, Shellsolv AB, Avjet, toluene, xylene, and the like and mixtures thereof.

It will be understood by those skilled in the art that the foregoing reaction product will contain a complex mixture of compounds including fatty acid amides, fatty acid esters, fatty acid ester-amides, unreacted starting reactants, free fatty acids, glycerol, and partial fatty acid esters of glycerol (i.e., mono- and di-glycerides). Typically, the reaction product will contain from about 5 to about 65 mole % of the additive fatty acid amide as well as about 5 to about 65 mole % of the by-product amide mono- and di-ester compounds, about 3 to about 30 mole % of the by-product amino mono- and di-ester compound, about 0.1 to about 50 mole % of the by-product hydroxyl mono- and di-ester compounds, about 0.1 to about 30 mole % of the by-product typified by glycerol, about 0.1 to about 30 mole % of carboxylic acids, about 0.1 to about 30 mole % of the charge amine, about 0.1 to about 30 mole % of the charge triglycerides, etc. The reaction product mixture need not be separated to isolate one or more specific components. Thus, the reaction product mixture can be employed as is in the fuel additive composition of this invention. The preferred reaction products can be those disclosed in U.S. Pat. No. 4,729,769, the contents of which are incorporated by reference herein.

Generally, the friction modifying amount of the foregoing reaction product employed in the fuel additive composition of this invention will range from about 10 to about 1000 pounds per thousand barrels (PTB), preferably from about 20 to about 500 PTB and more preferably from about 50 to about 260 PTB.

The fuel detergent for use in the fuel additive composition of this invention can be any commercially available fuel detergent known to one skilled in the art employed to reduce the incidence of deposit formation in the combustion chamber and intake system of an engine. Suitable fuel detergents include any polyether amine and/or one or more of the type based on a polyolefin, e.g., polyethylene, polypropylene, polybutylene, including isomers thereof, and copolymers of at least two of the foregoing; and polyolefin-based detergents, e.g., imides such as succinimide, amines and the like where the latter may be made by chlorinating selected olefins, and reacting the thus-chlorinated olefins with polyamines, e.g., ethylenediamine, tetraethylenepentaamine, etc. A suitable selected olefin is polyisobutene having a molecular weight in the range of from 450 to 1500, and more preferably 900 to 1400. Another suitable detergent may be based on a polyisobutene, preferably of molecular weight in the range of from 450 to 1500, more preferably 900 to 1400, which has been reacted with maleic acid and the resulting acid-functionalised polyolefin thereafter reacted with a polyamine such as tetraethylenepentamine. Processes not involving chlorine are also known. For example, the OXO process used by BASF in preparing a polyolefin-amine which are commercially available as Puradd FD-100 and the like.

Another suitable detergent for use herein is a Mannich base detergent. The Mannich base detergent can be any commercially available Mannich base known to one skilled in the art. Mannich bases are known compounds which have been found to be useful as, for example, dispersants, detergents, corrosion inhibitors when used as fuel additives. Representative of the Mannich bases are those disclosed in U.S. Pat. Nos. 3,368,972; 3,413,347; 3,539,633; 3,752,277; 4,231,759; and, 5,634,951 the contents of which are incorporated by reference herein.

In general, Mannich bases can be obtained from, for example, the condensation reaction product of an alkylphenol, aldehyde and amine or polyamine. Methods for preparing these Mannich base compounds are known in the art and do not constitute a part of the present invention. The alkylphenol can be mono or dialkyl substituted with the alkyl group being substituted in the para position being preferred. The alkyl group can contain from about 50 to about 20,000 carbon atoms, and preferably from about 200 to about 300 carbon atoms. Suitable alkylphenols include polypropylphenol, polybutylphenol, polyisobutylphenol, polypentylphenol, polybutyl-co-polypropylphenols and the like. Other similar long-chain alkylphenols may be used, but are less preferred.

The aldehyde employed in the Mannich base can be free aldehyde, aqueous solution of aldehyde or a polymerized form of an aldehyde which can provide monomeric aldehyde under the reaction conditions. Representative aldehydes for use in the preparation of the Mannich base products include aliphatic aldehydes such as formaldehyde, acetaldehyde, propionaldehyde, butyraldehyde, valeraldehyde, caproaldehyde, heptaldehyde, stearaldehyde and the like; aromatic aldehydes such as benzaldehyde, salicylaldehyde and the like, heterocyclic aldehydes such as furfural, thiophene aldehyde and the like. Other aldelhydes include formaldehyde-producing reagents such as paraformaldehyde, aqueous formaldehyde solutions e.g., formalin and the like, with formaldehyde and formalin being preferred.

The amine can be any one of a wide range of amines having a reactive nitrogen group, and generally contains less than about 100 carbon atoms. Suitable amines include polyamines of the general formula:

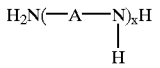

wherein A is a divalent alkylene radical of 2 to about 6 carbon atoms and x is an integer of 1 to 10 and preferably of 2 to 6. Useful polyamines include poly-ethyleneamines, propylene-polyamines, ethylenediamine, diethylenetriamine, triethylenetetramine, tetraethylenepentamine, pentaethylene hexamine, hexaethyleneheptamine, propylenediamine, dipropylenetriamine, tripropylenetetramine, tetrapropylenepentamine, pentapropylenehexamine, hexapropyleneheptamine and the like with ethylenepolyamines such as tetraethylenepentamine being preferred. The polyamines can be prepared by methods well-known in the art.

When a polyamine which has more than two amino groups is a reactant, and more than two moles each of alkylphenol and formaldehyde per mole of polyamine are used, the internal amino groups may also have alkyl-and hydroxy-substituted benzyl substituents. Depending upon the particular polyamine used, the particular ratio of alkylphenol and formaldehyde to polyamine employed, the reaction produced may have none, some, or all of the internal amine groups of the polyamine substituted with an alkyl-and hydroxy-substituted benzyl group.

Any amine used may have additional substitutions so long as it does not destroy the fuel solubility of the final Mannich compound, and does not interfere with the Mannich condensation. For example, hydroxyl substituted amines can be employed herein.

The preferred Mannich base detergent for use herein is obtained by alkylating phenol with a polyolefin and reacting the resulting alkylated phenol with a polyamine and formaldehyde. A detergent of this type is available from Ethyl Company (Richmond, Va.) under the tradename HiTEC-4995 and HiTEC-4997.

The fuel detergent(s) are employed in the fuel additive composition of this invention in an amount ordinarily ranging from about 10 to about 1000 PTB and preferably from about 15 to about 400 PTB.

If desired, the reaction product of natural or synthetic oil(s) and alkanolamine and the fuel detergent(s) can be used in combination with a carrier. Such carriers can be of various types such as liquid carriers (also referred to as a solvent, diluent or induction aid) or solids, e.g., waxes, with liquid carriers being preferred. Representatives of the liquid carriers that can be used herein are those disclosed in U.S. Pat. Nos. 5,551,957, 5,634,951 and 5,679,116, the contents of which are incorporated by reference herein. Examples of suitable liquid carriers include such materials as liquid poly-α-olelfin oligomers such as, for example, hydrotreated and unhydrotreated poly-α-olefin oligomers, i.e., hydrogenated or unhydrogenated products, primarily trimers, tetramers and pentamers of α-olefin monomers which monomers contain from about 6 to about 12 carbon atoms; liquid polyalkene hydrocarbons, e.g., polypropene, polybutene, polyisobutene, or the like; liquid hydrotreated polyalkene hydrocarbons, e.g., hydrotreated polypropene, hydrotreated polybutuene, hydrotreated polyisobutene, or the like; mineral oils; liquid polyoxyalkylene compounds; liquid alcohols or polyols; liquid esters, and similar liquid carriers or solvents. It is also contemplated that mixtures of two or more such carriers or solvents can be employed herein.

Preferred liquid carriers for use herein are polyethers such as substituted polyethers, cyclic polyethers (i.e., crown ethers), aromatic polyethers, polyether alcohols, and the like with polyether alcohols being most preferred. In general, the polyether alcohol(s) will possess the general formula

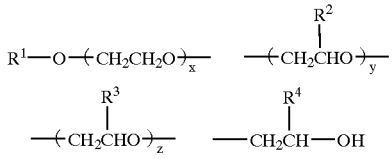

wherein x is an integer from 0 to about 5, y is an integer from 1 to about 49 preferably from about 5 to about 40 and more preferably from about 5 to about 10, z is an integer from 1 to about 49, preferably from about 5 to about 40 and more preferably from about 5 to about 10 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms, including, by way of illustration, unsubstituted straight or branched aliphatic, cycloaliphatic and aromatic groups and cycloaliphatic and aromatic groups substituted with one or more straight or branched aliphatic, cycloaliphatic and/or aromatic groups. Thus, for example, $R^1$ can be represented by the general formula

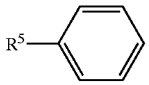

wherein $R^5$ is a hydrocarbyl group of from about 4 to about 30 carbon atoms including, by way of example, a monovalent aliphatic radical having from about 6 to about 24 carbon atoms, preferably from about 8 to about 20 carbon atoms and more preferably from about 9 to about 18 carbon atoms. $R^2$ and $R^3$ each is different and is an alkyl group of from 1 to 4 carbon atoms and each oxyalkylene radical can be any combination of repeating oxyalkylene units to form random or block copolymers with the random copolymers being preferred; $R^4$ is the same as $R^2$ or $R^3$. The preferred polyether alcohol for use herein as the liquid carrier is a mixture of 2-(4-n-nonyl (poly(propylene oxide-co-butylene oxide) phenylether)-1-n-propyl alcohol and 2-(4-n-nonyl (poly(propylene oxide-co-butylene oxide) phenylether)-1-n-butyl alcohol.

In general, the polyether alcohol useful as the liquid carrier can be obtained by first reacting an alkylaryl or a hydrocarbyl alcohol represented by the general formula $R^1$—OH wherein $R^1$ has the aforestated meaning with at least two 1,2-epoxides represented by the general formulae

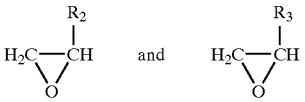

wherein $R^2$ and $R^3$ have the aforestated meanings. Optionally, a small amount of ethylene oxide, e.g., up to about 35%, can be added to the foregoing reaction to provide a hydrocarbyl polyoxyalkylene hydroxide represented by the general formula

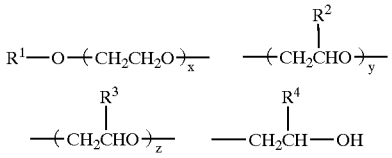

wherein $R^1$, $R^2$, $R^3$, $R^4$, x, y and z have the aforestated meanings. Preferred 1,2-epoxides for use herein include, but are not limited to, ethylene oxide, propylene oxide, butylene oxide and the like.

The hydrocarbyl alcohol and at least two 1,2,-epoxides are advantageously reacted to form a reaction mixture of the hydrocarbyl polyoxyalkylene hydroxide in a mole ratio ordinarily ranging from about 1 to about 100 and preferably from about 5 to about 25. The reaction is ordinarily conducted at a temperature ranging from about 50° C. to about 400° C. and preferably from about 100° C. to about 150° C. The time for preparing the hydrocarbyl polyoxyalkylene hydroxide, under preferred parameters, will generally not exceed 3 hours.

The hydrocarbyl polyoxyalkylene hydroxide is then acidified to form the desired polyether alcohol by passing the reaction mixture through an acidic resin.

The amount of liquid carrier employed in the fuel additive composition of this invention will ordinarily range from about 10 PTB to about 1000 PTB along with equal portions of the fuel detergent.

The additive composition of this invention can be prepared by mixing the reaction product (a) with the fuel detergent (b) and, optionally, liquid carrier (c) either sequentially or in any suitable order. For example, the reaction product can be combined with the Mannich base and then this mixture is combined with the liquid carrier or a mixture of Mannich base and liquid carrier can be combined with the reaction product. This mixing can take place before the addition of the composition to the fuel or during the mixing of a fuel containing the additive composition of this invention. The order of addition and/or combinations of the various components of this invention is therefore not critical and all such orders of addition and/or combination of the components are envisioned as being within the scope of the invention herein.

In the fuel additive composition and/or fuel composition of this invention, other fuel additives can be employed to enhance the performance of the fuel, including, for example, antioxidants, corrosion inhibitors, dehazers, demulsifiers, metal deactivators, antifoaming agents, combustion improvers such as cetane improvers, co-solvents, package compatibilisers, metallic-based additives such as metallic combustion improvers, anti-knock agents such as tetraethyl lead compounds, anti-icing additives, dyes, one or more fuel-soluble antioxidants, octane improvers, emission reducers, ancillary detergent/dispersant additives, and the like and mixtures thereof.

The fuel additive composition of this invention is particularly useful when employed as an additive in an internal combustion engine fuel composition to improve the delivery of a friction modifier to the combustion chamber and crankcase lubricant. Thus, the fuel composition will contain a major amount of an internal combustion engine fuel and a minor effective amount of at least one fuel additive composition of this invention. In general, the amount of the fuel additive composition employed in the fuel composition can range from about 20 PTB to about 2000 PTB, preferably from about 30 PTB to about 300 PTB and more preferably from about 50 PTB to about 150 PTB.

The fuel in which the additive composition of the invention can be used can be any hydrocarbon fuel, e.g., diesel, gasoline, kerosene, jet fuels, etc.; alcoholic fuels such as methanol or ethanol; or, a mixture of hydrocarbon and alcoholic fuels. When the fuel is diesel, such fuel generally boils above about 212° F. The diesel fuel can comprise atmospheric distillate or vacuum distillate, or a blend in any proportion of straight run and thermally and/or catalytically cracked distillates. Preferred diesel fuels have a cetane number of at least 40, preferably above 45 and more preferably above 50. The diesel fuel can have such cetane numbers prior to the addition of any cetane improver. The cetane number of the fuel can be raised by the addition of a cetane improver.

When the fuel is gasoline, it can be derived from straight-chain naphtha, polymer gasoline, natural gasoline, catalytically cracked or thermally cracked hydrocarbons, catalytically reformed stocks, and the like. It will be understood by one skilled in the art that gasoline fuels typically boil in the range of from about 80° F. to about 450° F. and can consist of straight chain or branched chain paraffins, cycloparaffins, olefins, and aromatic hydrocarbons and any mixture of these.

Generally, the composition and octane or cetane level of the fuels are not critical and any conventional fuel can be employed herein.

A fuel composition containing the fuel additive composition of the invention is suitable for the operation of an internal combustion engine. When the base fuel is diesel, the fuel composition will be suitable for use in, e.g., compression-ignition engines typically operated on such fuels. When the base fuel is gasoline, the fuel composition will be suitable for use in, e.g., spark-ignition engines typically operated on such fuels. It is to be understood that the fuel compositions containing the fuel additive composition of this invention can be used to operate a variety of engines and in any other application requiring a fuel having improved delivery of friction modifier, e.g., jet engines, furnaces, etc.

The following examples serve to illustrate the method of making the present fuel additive composition and its use as a fuel additive for improving the delivery of a friction modifier for fuel compositions.

Experimental Section

I. Preparation of Friction Modifier

EXAMPLE 1

1.3 Kg coconut oil (approximate molecular weight 657 AMU) was heated to about 60° C. and 0.38 Kg diethanolamine was added with stirring. The mixture was then heated under nitrogen to 120° C. and held at 120° C. for 4 hours and polish-filtered at 100°–120° C. The product was quantitatively isolated as a yellow semi-solid containing a nitrogen content of 2.9% and base number TBN target of 9.

EXAMPLE 2

The procedure of Example 1 was followed employing 26.7 g (0.4 mole) of coconut oil and 73.44 g (0.72 mole) of diethanolamine.

The product contained 2.8% nitrogen and a base number TBN of 9.4.

Results comparable to those of Examples 1 and 2 may be obtained if the reactants are as follows:

TABLE 1

| Example | Oil | Amine |
|---|---|---|
| 3 | Corn Oil | ethanolamine |
| 4 | Peanut Oil | diethanolamine |
| 5 | Soya Oil | diethanolamine |
| 6 | Palm Oil | ethanolamine |
| 7 | Olive Oil | propanolamine |

II. Preparation of Fuel Blends

Gasoline Blend 1

Gasoline fuel was additized with 80 PTB of the friction modifier of Example 1.

Gasoline Blend 2

Gasoline fuel was additized with both 80 PTB of the friction modifier of Example 1 as well as 59 PTB of the fuel detergent condensation product of polyisobutylenephenol, formaldehyde and 3-(N,N-dimethyl)-1,3-propane-diamine.

III. Test Results

Gasoline Blend 1 (outside the scope of this invention) was then compared to Gasoline Blend 2 (within the scope of this invention) by testing these Blends using a Honda Generator engine operated at a governed speed of 3600 rpm and incorporated a twin cylinder, overhead camshaft and water-cooled engine as described below in Table 2.

TABLE 2

| Engine Data for ES6500 Honda Generator | |
|---|---|
| Type: 4-stroke | Overhead cam, 2 cylinder |
| Cooling System: | Liquid cooled |
| Displacement: | 359 cc |
| Bore × stroke: | 58 × 68 mm |
| Construction: | Aluminum head and block, fixed cast iron cylinder liners |
| Compression: | 8.5:1 |
| Maximum Power: | 9.1 Kw/3600 rpm |
| Maximum Torque: | 240 kg-cm |
| Fuel System: | Carburetor |

FTIR analytical methods indicated that the friction modifier delivered in the crankcase lubricant oil of the engine was increased by 8.46% when used in conjunction with a detergent (Gasoline Blend 2) within the scope of this invention as compared to Gasoline Blend 1 containing only a friction modifier which is outside the scope of this invention.

The FTIR experimental parameter were:

A. Resolution=4.0 $cm^{-1}$

B. Scan=64

C. Cell=1.0 mm NaCl transmission cell.

What is claimed is:

1. A fuel additive composition for improving the delivery of friction modifier to the lubricant of an internal combustion engine comprising:

(a) a friction modifying amount of a reaction product of at least one natural or synthetic oil and at least one alkanolamine; and, (b) at least one fuel detergent effective to deliver the friction modifying amount of the reaction product of component (a) to the crankcase oil of the internal combustion engine, the fuel detergent being selected from the group consisting of Mannich base detergents, polyetheramines, polyolefin-amines, polyolefin-polyamines, polyolefin-phenol-polyamines, polyolefin succinimides and mixtures thereof.

2. The fuel additive composition of claim 1 wherein the reaction product is the product of a natural oil and an alkanolamine, the natural oil being a mixed $C_6$–$C_{22}$ fatty acid ester.

3. The fuel additive composition of claim 2 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

4. The fuel additive composition of claim 1 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

5. The fuel additive composition of claim 1 wherein the weight ratio of natural or synthetic oil to alkanolamine is from about 0.2 to about 3.

6. The fuel additive composition of claim 1 wherein the amount of reaction product of component (a) is from about 10 to about 1000 PTB.

7. The fuel additive composition of claim 1 wherein the amount of the fuel detergent is from about 10 to about 1000 PTB.

8. The fuel additive composition of claim 1 further comprising a liquid carrier.

9. The fuel additive composition of claim 8 wherein the liquid carrier is a polyether selected from the group consisting of substituted polyethers, cyclic polyethers aromatic polyethers and polyether alcohols.

10. The fuel additive composition of claim 9 wherein the polyether alcohols possess the general formula

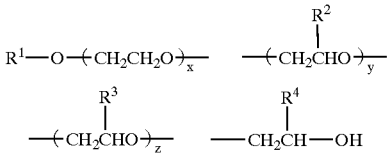

wherein x is an integer from 0 to about 5, y is an integer from 1 to about 49, z is an integer from 1 to about 49 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms; $R^2$ and $R^3$ each is different and is an alkyl group of from 1 to 4 carbon atoms and each oxyalkylene radical can be any combination of repeating oxyalkylene units to form random or block copolymers; and $R^4$ is the same as $R^2$ and $R^3$.

11. The fuel additive composition of claim 10 wherein the polyether alcohol is a mixture of 2-(4-n-nonyl (poly (propylene oxide-co-butylene oxide) phenylether)-1-n-propyl alcohol and 2-(4-n-nonyl(poly(propylene oxide-co-butylene oxide) phenylether)-1-n-butyl alcohol.

12. The fuel additive composition of claim 8 wherein the amount of the liquid carrier is from about 10 to about 1000 PTB.

13. A fuel composition comprising:

(a) a major amount of an internal combustion engine fuel selected from the group consisting of gasoline, alcoholic fuels and mixtures thereof; and, (b) a minor effective amount of at lease one fuel additive composition comprising:

(i) a friction modifying amount of a reaction product of at least one natural or synthetic oil and at least one alkanolamine; and (ii) at least one fuel detergent effective to deliver the friction modifying amount of the reaction product of component (i) to the crankcase oil of the internal combustion engine, the fuel detergent being selected from the group consisting of Mannich base detergents, polyetheramines, polyolefin-amines, polyolefin-polyamines, polyolefin-phenol-polyamines, polyolefin succinimides and mixtures thereof.

14. The fuel composition of claim 13 wherein the reaction product is the product of a natural oil and an alkanolamine, the natural oil being a mixed $C_6$–$C_{22}$ fatty acid ester.

15. The fuel composition of claim 14 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

16. The fuel composition of claim 13 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

17. The fuel composition of claim 13 wherein the weight ratio of natural or synthetic oil to alkanolamine is from about 0.2 to about 3.

18. The fuel composition of claim 13 wherein the amount of reaction product of component (a) present in the fuel additive composition is from about 10 to about 1000 PTB.

19. The fuel composition of claim 13 wherein the amount of the fuel detergent present in the fuel additive composition is from about 10 to about 1000 PTB.

20. The fuel composition of claim 13 wherein the fuel additive composition further comprises a liquid carrier.

21. The fuel composition of claim 20 wherein the liquid carrier is a polyether selected from the group consisting of substituted polyethers, cyclic polyethers aromatic polyethers and polyether alcohols.

22. The fuel composition of claim 21 wherein the polyether alcohols possess the general formula

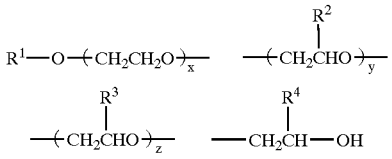

wherein x is an integer from 0 to about 5, y is an integer from 1 to about 49, z is an integer from 1 to about 49 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms; $R^2$ and $R^3$ each is different and is an alkyl group of from 1 to 4 carbon atoms and each oxyalkylene radical can be any combination of repeating oxyalkylene units to form random or block copolymers; and $R^4$ is the same as $R^2$ and $R^3$.

23. The fuel composition of claim 22 wherein the polyether alcohol is a mixture of 2-(4-n-nonyl (poly(propylene oxide-co-butylene oxide) phenylether)-1-n-propyl alcohol and 2-(4-n-nonyl(poly(propylene oxide-co-butylene oxide) phenylether)-1-n-butyl alcohol.

24. The fuel composition of claim 20 wherein the amount of the liquid carrier present in the fuel additive composition is from about 10 to about 1000 PTB.

25. The fuel composition of claim 13 wherein the fuel additive composition is present in an amount from about 20 to about 2000 PTB.

26. The fuel composition of claim 13 wherein the fuel additive composition is present in an amount from about 50 to about 150 PTB.

27. The fuel composition of claim 13 further comprising other fuel additives selected from the group consisting of antioxidants, corrosion inhibitors, dehazers, demulsifiers, metal deactivators, antifoaming agents, combustion improvers, metallic-based additives, anti-knock agents, anti-icing additives and mixtures thereof.

28. A method of operating an internal combustion engine which comprises operating the engine employing as a fuel therefor a fuel composition which comprises:

(a) a major amount of an internal combustion engine fuel selected from the group consisting of gasoline, alcoholic fuels and mixtures thereof; and, (b) a minor effective amount of at least one fuel additive composition comprising:

(i) a friction modifying amount of a reaction product of at least one natural or synthetic oil and an alkanolamine; and, (ii) at least one fuel detergent effective to deliver the friction modifying amount of the reaction product of component (i) to the crankcase oil of the internal combustion engine, the fuel detergent being selected from the group consisting of Mannich base detergents, polyetheramines, polyolefin-amines, polyolefin-polyamines, polyolefin-phenol-polyamines, polyolefin succinimides and mixtures thereof.

29. The method of claim 28 wherein the reaction product is the product of a natural oil and an alkanolamine, the natural oil being a mixed $C_6$–$C_{22}$ fatty acid ester.

30. The method of claim 29 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

31. The method of claim 28 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

32. The method of claim 28 wherein the weight ratio of natural or synthetic oil to alkanolamine is from about 0.2 to about 3.

33. The method of claim 28 wherein the amount of the fuel detergent present in the fuel additive composition is from about 10 to about 1000 PTB.

34. The method of claim 28 wherein the fuel additive composition further comprises a liquid carrier.

35. The method of claim 34 wherein the liquid carrier is a polyether selected from the group consisting of substituted polyethers, cyclic polyethers aromatic polyethers and polyether alcohols.

36. The method of claim 35 wherein the polyether alcohols possess the general formula

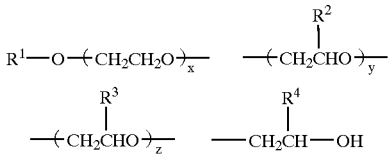

wherein x is an integer from 0 to about 5, y is an integer from 1 to about 49, z is an integer from 1 to about 49 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms; $R^2$ and $R^3$ each is different and is an alkyl group of from 1 to 4 carbon atoms and each oxyalkylene radical can be any combination of repeating oxyalkylene units to form random or block copolymers; and $R^4$ is the same as $R^2$ and $R^3$.

37. The method of claim 36 wherein the polyether alcohol is a mixture of 2-(4-n-nonyl (poly(propylene oxide-co-butylene oxide) phenylether)-1-n-propyl alcohol and 2-(4-n-nonyl(poly(propylene oxide-co-butylene oxide) phenylether)-1-n-butyl alcohol.

38. The method of claim 34 wherein the amount of the liquid carrier present in the fuel additive composition is from about 10 to about 1000 PTB.

39. The method of claim 28 wherein the fuel additive composition is present in an amount of from about 20 to about 2000 PTB.

40. The method of claim 28 wherein the fuel additive composition is present in an amount of from about 50 to about 150 PTB.

41. The method of claim 30 wherein the fuel composition further comprises other fuel additives selected from the group consisting of antioxidants, corrosion inhibitors, dehazers, demulsifiers, metal deactivators, antifoaming agents, combustion improvers, metallic-based additives, anti-knock agents, anti-icing additives and mixtures thereof.

42. A method for reducing and/or preventing friction in the operation of an internal combustion engine which comprises fueling the engine with a fuel composition comprising (a) a major amount of an internal combustion engine fuel selected from the group consisting of gasoline, alcoholic fuels and mixtures thereof; and (b) a minor effective amount of a fuel additive composition comprising:

(i) a friction modifying amount of a reaction product of at least one natural or synthetic oil and an alkanolamine; and, (ii) at least one fuel detergent effective to deliver the friction modifying amount of the reaction product of component (i) to the crankcase oil of the internal combustion engine, the fuel detergent being selected from the group consisting of Mannich base detergents, polyetheramines, polyolefin-amines, polyolefin-polyamines, polyolefin-phenol-polyamines, polyolefin succinimides and mixtures thereof.

43. The method of claim 42 wherein the reaction product is the product of a natural oil and an alkanolamine, the natural oil being a mixed $C_6$–$C_{22}$ fatty acid ester.

44. The method of claim 43 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

45. The method of claim 42 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

46. The method of claim 42 wherein the fuel additive composition further comprises a liquid carrier.

47. The method of claim 34 wherein the liquid carrier is a polyether selected from the group consisting of substituted polyethers, cyclic polyethers aromatic polyethers and polyether alcohols.

48. The method of claim 47 wherein the polyether alcohol is a mixture of 2-(4-n-nonyl (poly(propylene oxide-co-butylene oxide) phenylether)-1-n-propyl alcohol and 2-(4-n-nonyl(poly(propylene oxide-co-butylene oxide) phenylether)-1-n-butyl alcohol.

49. The method of claim 42 wherein the fuel additive composition is present in an amount of from about 20 to about 2000 PTB.

50. The method of claim 42 wherein the fuel additive composition is present in an amount of from about 50 to about 150 PTB.

51. The fuel additive composition of claim 1 wherein the reaction product is the product of a synthetic oil and an alkanolamine, the synthetic oil being selected from the group consisting of alkoxylated alkylphenols, alkoxylated alcohols, polyalkeneoxide based alcohols and diols, ethers of polyalkeneoxide based alcohols and diols, esters of alkoxylated alkylphenols with carboxylic acids, esters of alkoxylated alcohols with carboxylic acids, esters of polyalkeneoxide based alcohols and diols with carboxylic acids, ethers of alkoxylated alkylphenols, ethers of alkoxylated alcohols, ethers of polyalkeneoxide based alcohols and diols, esters of aliphatic acids, esters of aliphatic alcohols and mixtures thereof.

52. The fuel composition of claim 13 wherein the reaction product is the product of a synthetic oil and an alkanolamine, the synthetic oil being selected from the group consisting of alkoxylated alkylphenols, alkoxylated alcohols, polyalkeneoxide based alcohols and diols, ethers of polyalkeneoxide based alcohols and diols, esters of alkoxylated alkylphenols with carboxylic acids, esters of alkoxylated alcohols with carboxylic acids, esters of polyalkeneoxide based alcohols and diols with carboxylic acids, ethers of alkoxylated alkylphenols, ethers of alkoxylated alcohols, ethers of polyalkeneoxide based alcohols and diols, esters of aliphatic acids, esters of aliphatic alcohols and mixtures thereof.

53. The method of claim 28, wherein the reaction product is the product of a synthetic oil and an alkanolamine, the synthetic oil being selected from the group consisting of alkoxylated alkylphenols, alkoxylated alcohols, polyalkeneoxide based alcohols and diols, ethers of polyalkeneoxide based alcohols and diols, esters of alkoxylated alkylphenols with carboxylic acids, esters of alkoxylated alcohols with carboxylic acids, esters of polyalkeneoxide based alcohols and diols with carboxylic acids, ethers of alkoxylated alkylphenols, ethers of alkoxylated alcohols, ethers of polyalkeneoxide based alcohols and diols, esters of aliphatic acids, esters of aliphatic alcohols and mixtures thereof.

54. The method of claim 42 wherein the reaction product is the product of a synthetic oil and an alkanolamine, the synthetic oil being selected from the group consisting of alkoxylated alkylphenols, alkoxylated alcohols, polyalkeneoxide based alcohols and diols, ethers of polyalkeneoxide based alcohols and diols, esters of alkoxylated alkylphenols with carboxylic acids, esters of alkoxylated alcohols with carboxylic acids, esters of polyalkeneoxide based alcohols and diols with carboxylic acids, ethers of alkoxylated alkylphenols, ethers of alkoxylated alcohols, ethers of polyalkeneoxide based alcohols and diols, esters of aliphatic acids, esters of aliphatic alcohols and mixtures thereof.

55. The fuel composition of claim 13 wherein the fuel additive composition is present in an amount from about 30 PTB to about 300 PTB.

56. The method of claim 28 wherein the fuel additive composition is present in the fuel composition in an amount from about 30 PTB to about 300 PTB.

57. The method of claim 42, wherein the fuel additive composition is present in the fuel composition in an amount from about 30 PTB to about 300 PTB.

58. The fuel additive of claim 1 wherein the reaction product is the product of a natural oil and an alkanolamine, the natural oil being a glycerol $C_6$–$C_{22}$ fatty acid ester.

59. The fuel composition of claim 13 wherein the reaction product is the product of a natural oil and an alkanolamine, the natural oil being a glycerol $C_6$–$C_{22}$ fatty acid ester.

60. The method of claim 28 wherein the reaction product is the product of a natural oil and an alkanolamine, the natural oil being a glycerol $C_6$–$C_{22}$ fatty acid ester.

61. The method of claim 42 wherein the reaction product is the product of a natural oil and an alkanolamine, the natural oil being a glycerol $C_6$–$C_{22}$ fatty acid ester.

* * * * *

UNITED STATES PATENT AND TRADEMARK OFFICE

CERTIFICATE OF CORRECTION

PATENT NO. : 6,743,266 B2
DATED : June 1, 2004
INVENTOR(S) : DeRosa et al.

It is certified that error appears in the above-identified patent and that said Letters Patent is hereby corrected as shown below:

Column 1,
Line 21, change “inn” to -- in --.

Column 6,
Line 63, change “aldelhydes” to -- aldehyde --.

Column 7,
Line 65, change “polybutuene” to -- polybutene --.

Column 13,
Line 1, change “lease” to -- least --.

Signed and Sealed this

Fifth Day of April, 2005

JON W. DUDAS
*Director of the United States Patent and Trademark Office*